United States Patent [19]

Clouston

[11] Patent Number: 4,499,821

[45] Date of Patent: Feb. 19, 1985

[54] SYSTEM FOR IMMOBILIZING A PLYWOOD PRESS PLATEN DURING A PRESS CYCLE

[76] Inventor: John L. Clouston, 92966 Highway 99 South, Junction City, Oreg. 97448

[21] Appl. No.: 582,942

[22] Filed: Feb. 23, 1984

[51] Int. Cl.[3] ..... B30B 15/16

[52] U.S. Cl. ..... 100/51; 100/93 P; 100/195; 100/269 R; 156/358

[58] Field of Search ..... 156/358, 580; 100/93 P, 100/194, 195, 269 R, 48, 50, 51

[56] References Cited

U.S. PATENT DOCUMENTS 4,151,718 5/1979 Gravely ..... 156/580 X 4,367,115 1/1983 Bohn ..... 100/51 X

*Primary Examiner*—Billy J. Wilhite

*Attorney, Agent, or Firm*—James D. Givnan, Jr.

[57] ABSTRACT

A system for securing the thrust platen of a plywood press against movement during a panel pressing cycle to avert over compression of the panels being cured. An initial fluid circuit pressurizes the press cylinder. A timer terminates the first fluid circuit and establishes a fluid locking circuit which includes a valve assembly which may be coupled to a platen appendage so as to sense platen movement. Pressurized fluid is regulated to and from the press cylinder by the valve assembly to maintain desired platen position.

7 Claims, 2 Drawing Figures

3
4
5
1
17
18
19
20
21
22
25
2
7
6
8
P
10
11
T1
T2
13
15
16
12
12A
35
36
39
30
28
27
23
26
29
31
32
34
40

SYSTEM FOR IMMOBILIZING A PLYWOOD PRESS PLATEN DURING A PRESS CYCLE

BACKGROUND OF THE INVENTION

The present invention pertains generally to plywood presses in which plywood panels are cured with heat and pressure.

During a pressing cycle the plywood panels in a press are typically subjected to pressures ranging between 100–225 PSI. Current practice in plywood press operation may entail the use of stepped pressures with the lower pressure values associated with the later stages of a pressing cycle. Reducing of pressure exerted on the plywood panels during the later stages of a cycle has been found advantageous in that compression losses (i.e., a reduction in veneer and hence panel thickness) may be reduced. Such compression losses are undesirable for the reason that the anticipated lost veneer and hence panel thickness must be pre-compensated for by peeling the veneer at a somewhat greater thickness resulting in reduced veneer production per block peeled. It should be noted that the length of press cycle time, veneer moisture content and glue type are all factors in veneer compression losses.

A discussion of compression losses is presented in an article entitled "Compression of Douglas Fir Veneer During Pressing" in Volume L11, Nos. 4 and 5 of a magazine titled THE TIMBERMAN. A further discussion is found in a report entitled "Compression Losses In Hot Pressed Plywood" published in August 1982 by the Forest Research Laboratory, School of Forestry, Oregon State University at Corvallis, Oregon.

Efforts to reduce compression losses, in addition to including multi-step plywood presses, have included mechanisms actuated by the thrust platen of a press which mechanisms limit compression to a percentage of the original thickness of the press load. Such mechanisms are disclosed in the above noted magazine article and are not in wide use in the plywood industry perhaps by reason of their complexity.

Plywood presses being used presently provide a multi-stage (multi-pressure) pressing cycle. Further efforts to reduce compression losses have entailed the installation of additional pressure controls to single or multi-stage presses all at considerable expense. The multi-stage presses, as presently known, provide only a partial remedy to over compression losses while incurring considerable capital expenditure and increased maintenance effort.

U.S. Pat. No. 4,367,115 disclosees an electronic control system for a circuit board press wherein pressures are altered during a press cycle. U.S. Pat. No. 4,151,718 discloses an electrical control system for a plywood press. The harsh conditions attendant plywood press operations render electrical systems impractical.

SUMMARY OF THE PRESENT INVENTION

The present invention is embodied in a system for controlling thrust platen movement of a plywood press during a press cycle.

The present system is compatible with currently operating single or multi-stage plywood presses to enable low cost installation of the system.

By averting over compression of the panel cores and faces the same may be peeled at a somewhat lesser thickness than is currently the practice wherein over compression is compensated for during veneer manufacture. Over a work shift period, the greater production of reduced thickness veneer can amount to considerable savings in view of rapidly increasing log cost.

The present system includes a valve assembly responsive to changes in the position of a thrust platen during a panel pressing cycle. The valve assembly in response to platen movement controls a remedial fluid flow to the press cylinder which flow is terminated upon the platen reaching its desired elevation.

The present system is compatible with single or multistep plywwod presses and provides a practical remedy to averting veneer compression losses without resorting to costly retrofitting of the press hydraulic system.

The valve assembly of the present system senses platen movement during a press cycle within a few thousandths of an inch. During the cycle, after an initial stage of pressing, the control of the platen is shifted to a second stage using the present system. During the balance of the press cycle the static condition of the platen virtually precludes expansion or contraction of wood fibres to contribute toward panel strength.

Important objectives of the present invention include the provision of a system for immobilizing a plywood press thrust platen to prevent over compression of plywood panels being cured in the press; the provision of a system for immobilizing a plywood press platen during a press cycle whereat the platen is immobilized after the elapse of a preselected time interval which may be varied to best suit panel requirements; the provision of a system for immobilizing a plywood press platen which prevents platen movement after an initial stage of pressurization whereafter platen movement is virtually immobilized within the range of a few thousandths of an inch; the provision of a system for immobilizing a plywood press platen compatible with single or multi-step presses with minimum alteration of a press hydraulic system, the provision of a system for immobilizing a plywood press platen which lends itself to convenient time interval adjustment.

DETAILED DESCRIPTION OF THE PREFERRED EMBODIMENT

Figures 1, 2:
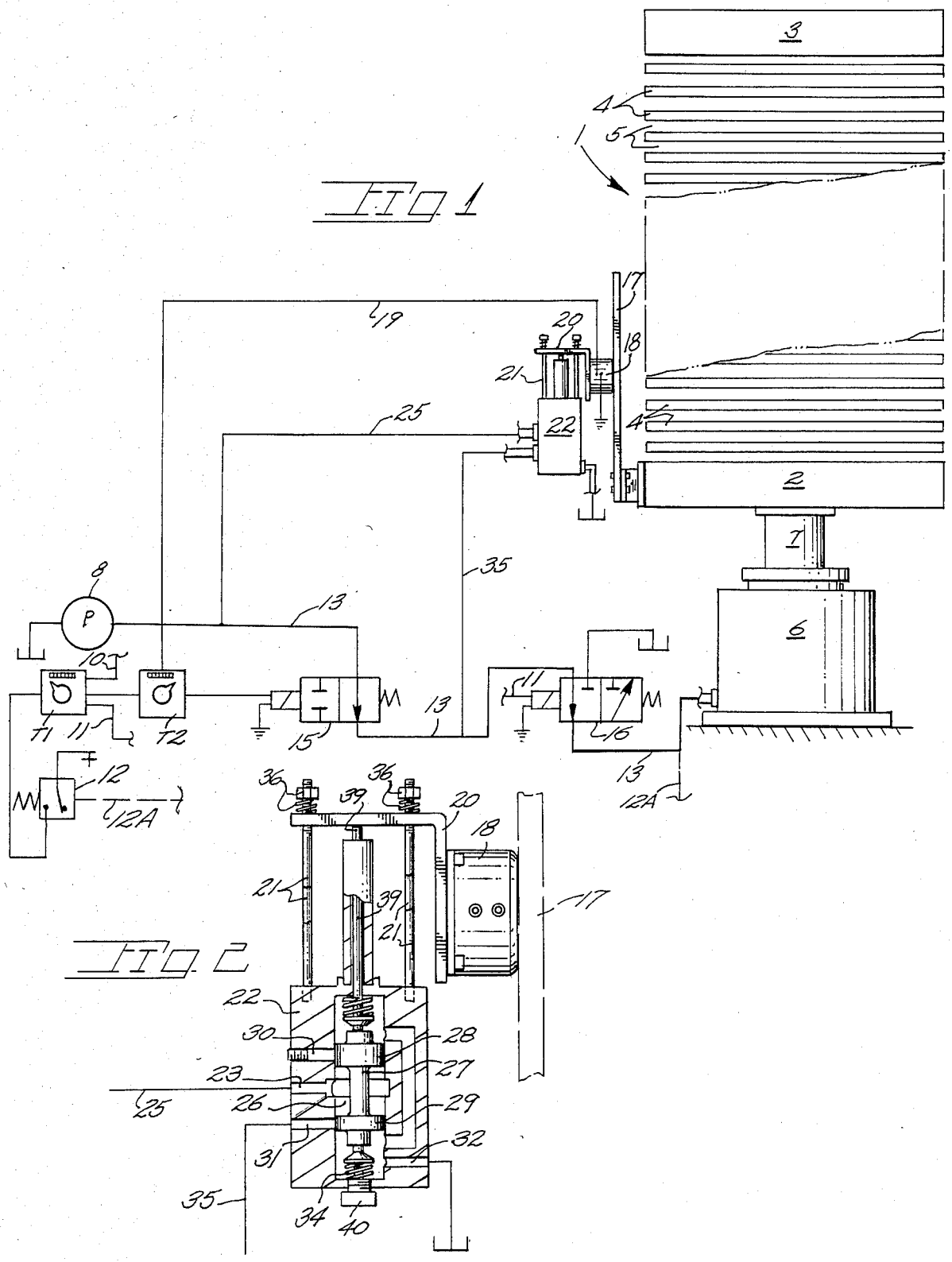
FIG. 1 is a schematic view of a plywood press served by the present system.
FIG. 2 is a sectional view of a valve assembly used in the present system.

With continuing attention to the drawing wherein applied reference numerals indicate parts hereinafter similarly identified, the reference numeral 1 indicates generally a plywood press of the type imparting heat and pressure to plywood panels to cure same during a cycle of press operation.

Plywood presses conventionally include a thrust platen 2 and a fixed platen 3 with intermediate movable platens 4 spaced therebetween and from one another to define panel receiving openings 5. A hydraulic cylinder 6 includes a ram 7, which biases thrust platen 2 upwardly to close the movable platens into pressured contact with the interposed plywood panels. The movable platens 4 are heated as by steam via conduits not shown. Press temperatures, pressures and pressing times will vary somewhat with the variable nature of the panels being pressed, e.g., panel thickness, veneer thickness, moisture content, glue type, specie of wood.

A pressure source is shown as a pump 8 which pressurizes cylinder 6 via a hydraulic line 13 during a press cycle with the pump associated with a motor and motor control not shown. Commonly, plywood press controls include a timer mechanism as at T1 which is set to limit the duration of pump operation via a lead 10 and to actuate a surge valve 16 via a lead 11 which valve exhausts cylinder pressure at the termination of a press cycle.

Timer T1 initiates timing of a press cycle upon cylinder 6 reaching a preset pressure which is imparted to a pressure operated switch 12 by a pilot line 12A. Timing out for timer T1 terminates the press cycle.

SYSTEM FOR IMMOBILIZING A PRESS THRUST PLATEN

The present system for immobilizing a plywood press platen is, as earlier noted, compatible with existing plywood press hydraulic systems permitting convenient retrofitting of such systems as described below.

A second timer at T2 is in circuit with timer T1 and includes a settable control calibrated in seconds. Upon timing out of timer T2, a circuit is established to an electromagnetic coupling device 18 via a lead 19. Further, timer T2 controls valve means shown as a solenoid actuated two-way valve at 15 which is normally open and in fluid circuit with pump 8 via fluid line 13. A second solenoid actuated, normally open valve at 16 is a three-way valve permitting a fluid flow to be communicated to hydraulic cylinder 6 and also venting the cylinder to tank. During an initial or first stage of press operation the positions of valves 15 and 16 are as shown.

Feedback means includes an appendage 17 carried by thrust platen 2 and shown as an upright metal plate which moves relative electromagnetic coupling means 18 during initial press closure. Electromagnet 18 is mounted on an angular plate member 20 which in turn is constrained for vertical movement by posts 21 in place on a valve assembly 22. The appendage 17, electromagnet 18 and plate 20 constitute feedback means to translate platen movement into actuation of valve assembly 22, Valve assembly 22, as best shown in FIG. 2, receives fluid pressure via a pressure line 25 serving a pump pressure port 23 and pressure chamber 26 of the valve assembly. A valve spool at 27 has lands 28 and 29. Valve ports are at 30 and 31 with a reservoir return port at 32. Port 30 may be plugged while port 31 serves fluid line 35 which is branched to line 13. A spool actuator at 39 is in end contact with plate 20. Spring 34 biases spool 27 while nut and spring combinations 36 bias plate 20 and spool 27 in an opposite direction. Accordingly, spool 27 responds to plate displacement (platen 2 movement) when coupled to the plate by electromagnet 18. A thumbscrew 40 enables the spool to be adjusted upwardly.

In operation, cylinder pressure starts timer T1 to commence a press cycle of several minutes. Timer T2 simultaneously initiates its timing function usually less than a minute. In a typical press cycle the press platen will exert an initial maximum force of 150–225 PSI on each panel being cured during the first stage. Timer T2 is set to time out to end the first stage and commence the second stage at which time electromagnet 18 of the feedback means is energized to couple valve assembly 22 to platen appendage 17. Simultaneously, valve means 15 is closed. Press cylinder 6 remains pressurized but isolated from the pressure source 8 by valve assembly 22. Should thrust platen 2 recede by reason of fluid leakage, or other cause, such movement is translated into axial movement of valve spool 27 to open port 31 to direct fluid pressure to press cylinder 6 with platen 2 being lifted to its initial position (that position coincident with timing out of timer T1) and spool land 29 elevated by spring 34 to close port 31. Oppositely, should platen 2 advance upwardly from said initial position, port 31 will be opened to permit a return flow from the press cylinder via line 35 through valve assembly 22 and back to tank or reservoir via port 32. The end of press cycle occurs at the timing out of timer T1 whereupon pump operation is terminated and surge valve 16 opened. As a minute degree of panel compression will occur during the second stage of the press cycle, the cylinder 6 will be at a reduced pressure to enable opening of surge valve 16 without the necessity of bleeding off hydraulic pressure to thereby expedite cylinder exhausting.

Valve assembly 22 may utilize an ABEX-DENNISON VALVE Mod. A with the spool land 29 reduced in thickness as by grinding the opposite top and bottom faces thereof to the extent the land has a deadband (maximum spool travel while maintaining port 31 closed) of 0.005 of an inch. Upon valve assembly 22 being adjusted to symmetrically locate land 29 with respect to port 31, the spool may move 0.0025 in either direction before opening port 31. Adjustable nut and spring elements 36 of the feedback means permit such positioning of land 29 with said elements also allowing electromagnet 18 being adjusted into plumb with appendage 17.

While I have shown but one embodiment of the invention it will be apparent to those skilled in the art that the invention may be embodied still otherwise without departing from the spirit and scope of the invention.

Having thus described the invention, what is desired to be secured under a Letters Patent is:

1. A system for immobilizing the hydraulic cylinder and thrust platen of a plywood press powered thereby during a panel pressing cycle to avoid excessive panel compression, said system comprising, a fluid pressure source, valve means in communication with said pressure source and the platen powering cylinder to control fluid pressure to the platen powering cylinder during a first stage of press operation, a valve assembly also in communication with said pressure source and the platen powering cylinder to control fluid pressure to said cylinder during a second stage of press operation, timing means controlling said valve means to close same upon timing out to simultaneously terminate the first stage of press operation and initiate the second stage of press operation, and feedback means for sensing thrust platen movement during said second stage from a preselected platen position and mechanically actuating said valve assembly upon sensing platen movement whereby the valve assembly will control fluid flow to said cylinder to return the platen to said preselected position.

2. The system claimed in claim 1 wherein said feedback means includes an upright appendage on said powered platen.

3. The system claimed in claim 2 wherein said feedback means additionally includes coupling means which is coupled to the upright appendage upon timing out of said timing means and for the duration of the second stage.

4. The system claimed in claim 3 wherein said coupling means is an electromagnet in circuit with said timing means.

5. The system claimed in claim 1 wherein said valve assembly has a valve spool deadband travel of approximately 0.005 of an inch to limit platen movement during the second stage to like travel.

6. The system claimed in claim 2 wherein said feedback means further includes a plate member, electromagnetic coupling means on said plate member and engageable with said appendage.

7. The system claimed in claim 6 wherein said feedback means additionally includes adjustable elements acting on said valve assembly for regulating operation of same.

* * * * *